United States Patent [19]

Samejima et al.

[11] Patent Number: 4,568,433

[45] Date of Patent: Feb. 4, 1986

[54] ELECTROLYTIC PROCESS OF AN AQUEOUS ALKALI METAL HALIDE SOLUTION

[75] Inventors: Yasushi Samejima, Kakogawa; Minoru Shiga, Himeji; Toshiji Kano, Kakogawa; Kiyoshi Yamada, Kobe, all of Japan

[73] Assignee: Kanegafuchi Kagaku Kogyo Kabushiki Kaisha, Osaka, Japan

[21] Appl. No.: 649,570

[22] Filed: Sep. 12, 1984

[30] Foreign Application Priority Data

Sep. 13, 1983 [JP] Japan ..... 58-169056

[51] Int. Cl.[4] ..... C25B 1/16

[52] U.S. Cl. ..... 204/98; 204/128

[58] Field of Search ..... 204/98, 128, 251

[56] References Cited

U.S. PATENT DOCUMENTS

| | | | |
|---|---|---|---|
| 1,109,311 | 9/1914 | Allen | 204/251 |
| 2,749,301 | 6/1956 | Rosenbloom | 204/251 |
| 3,677,926 | 7/1972 | Davis | 204/251 |
| 3,893,897 | 7/1975 | Raetzsch | 204/258 |
| 3,901,774 | 8/1975 | Montani et al. | 204/258 |
| 3,923,614 | 12/1975 | De Nora et al. | 204/257 |
| 3,976,550 | 8/1976 | De Nora et al. | 204/98 |
| 4,036,714 | 7/1977 | Spitzer | 204/251 |
| 4,101,407 | 7/1978 | Hilaire et al. | 204/251 |
| 4,137,136 | 1/1979 | Veda et al. | 204/128 |
| 4,331,521 | 5/1982 | Chisholm et al. | 204/98 |

*Primary Examiner*—Andrew H. Metz
*Assistant Examiner*—Terryence Chapman
*Attorney, Agent, or Firm*—Armstrong, Nikaido, Marmelstein & Kubovcik

[57] ABSTRACT

An electrolytic process using a horizontal electrolytic cell partitioned by a cation exchange membrane into an anode compartment and a cathode compartment is disclosed which is characterized by supplying into the cathode compartment catholyte liquor at a flow rate satisfying the equation;

$$Y \geqq 9 \log_{10} X + 11$$

wherein Y is initial linear velocity (cm/sec) of the catholyte liquor containing no cathode gas or containing cathode gas in an extremely small amount, and X is length (m) of a passageway of the catholyte liquor in the cathode compartment.

5 Claims, 6 Drawing Figures

FIG. 5
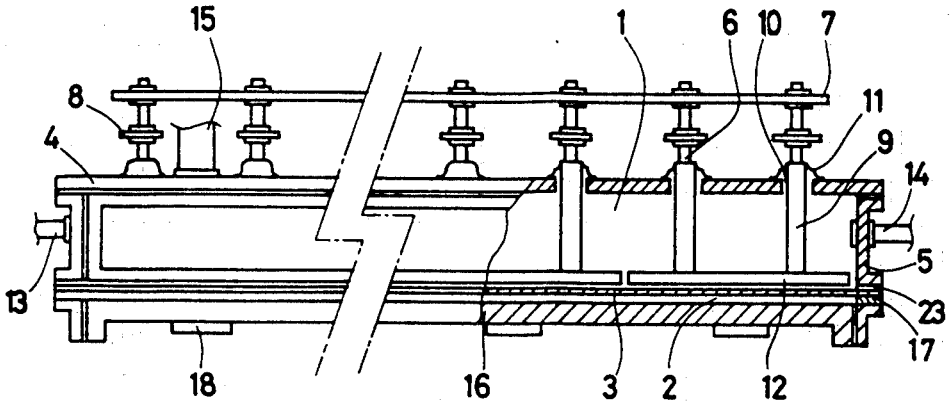
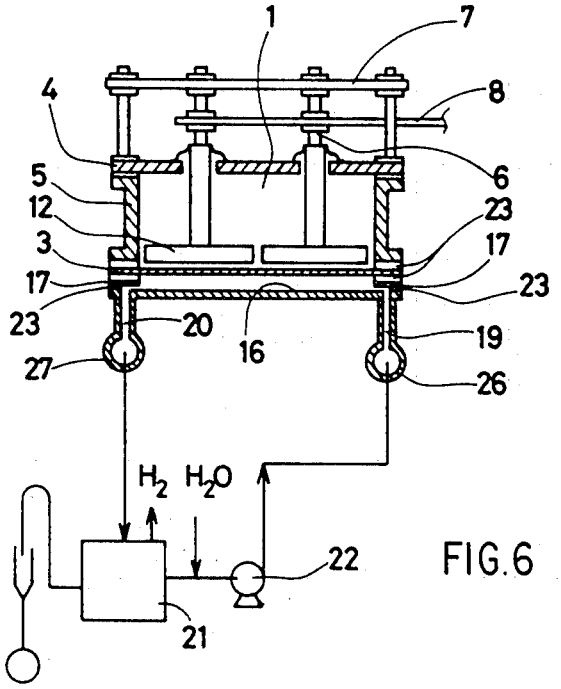
FIG. 6

ELECTROLYTIC PROCESS OF AN AQUEOUS ALKALI METAL HALIDE SOLUTION

BACKGROUND OF THE INVENTION

1. Field of the Invention

The present invention generally relates to an electrolytic process for electrolysis of an aqueous alkali metal halide solution, especially an aqueous alkali metal chloride solution. More particularly it relates to a process for obtaining a high quality caustic alkali more effectively with low cell voltage using a horizontal type electrolytic cell providing a cation exchange membrane as an electrolytic separator.

2. Description of Prior Art

The most typical horizontal electrolytic cell is a mercury electrolytic cell. However, use of such a cell will be discontinued in the near future in Japan since mercury which is used as a cathode contaminates the environment. To convert a mercury cathode electrolytic cell into a separator electrolytic cell which does not employ mercury, with a reduced cost, the separator electrolytic cell should be of a horizontal type. In view of this situation, a significant matter the industry is now encountering is to develop a process for producing a high quality product, which is not inferior to the product of the mercury process, with a high current efficiency using horizontal type separator electrolytic cells.

A process for retrofitting a mercury cell to a horizontal type separator cell is revealed in the U.S. Pat. No. 3,923,614. In the process, a porous membrane (diaphragm) is used to serve as a separator. However, such a porous membrane has great water permeability and accordingly anolyte solution passes through the separator hydraulically and mixes with, for example, caustic alkali produced in the cathode compartment. This results in decreased quality.

On the other hand, a cation exchange membrane called a non-porous membrane permits no passage of anolyte solution or catholyte liquor hydraulically. This membrane allows only water molecules coordination-bonded to alkali metal ions transported electrically to pass. Hence a high quality caustic alkali is obtained. However, a small quantity of water transported evaporates causing electric conduction failure between a membrane and a cathode therefor. This, in the long run, terminates the electrolytic reaction.

The U.S. Pat. No. 3,901,774 proposes processes to solve these problems. One is a process for placing a liquid maintaining material between a cation exchange membrane and a cathode and another is a process for carrying out the electrolysis while supplying to a cathode an aqueous caustic alkali liquor in mist or spray.

The former process involves problems including trouble in interposing the liquid maintaining material and the durability therefor of the material. The process also increases cell voltage because the distance between electrodes is expanded by the liquid maintaining material located between the cation exchange membrane and the cathode. Also, there is an increase in electric resistance of the liquid maintaining material per se. Hence it can not be an advantageous process. Moreover the latter process has some difficulties in practice on an industrial scale since it is difficult to provide a uniform supply of liquid when the process is applied to a large-scale electrolytic cell as employed commercially.

Further, in effecting electrolysis using a horizontal electrolytic cell providing a cation exchange membrane positioned substantially horizontal, it is important to prevent cathode gas, generated on a cathode, from residing on the underside of the membrane, i.e., to keep the underside of the membrane in contact with catholyte liquor. Convensionally, the cation exchange membrane has been used in a vertical type electrolytic cell. In such a case, for the purpose of rapidly removing cathode gas evolved on the cathode from a space between the cathode and the cation exchange membrane, a perforated cathode having an aperture of from 90 to 10% and formed from materials such as expanded metal sheets, punched metal sheets, nets, louver-like cathodes is used. The evolved gas is removed behind the cathode. On the other hand, in the case of the horizontal type electrolytic cell, it is impossible to cause gas evolved on the cathode below the cation exchange membrane to discharge behind the cathode, i.e., underneath the cathode against the buoyancy. Therefore, the space between the cathode and the membrane is filled with cathode gas which impedes electric conduction.

In order to eliminate the foregoing defects, a process has been considered in which catholyte liquor is circulated in the space between the cathode and the membrane to remove evolved gas together with the circulated catholyte liquor from the cathode compartment. With the conventional perforated cathodes, however, the circulated catholyte liquor is dispersed underneath the perforated cathode so that residence of gas in the space between the cathode and the membrane can not be prevented perfectly. As a result, part of gas remains to thus result in an increase in cell voltage.

SUMMARY OF THE INVENTION

An object of the present invention is to obtain a high quality caustic alkali with high efficiency using a horizontal type separator electrolytic cell.

Another object of the present invention is to provide an improved electrolytic process permitting no residence of cathode gas in a space formed between a cation exchange membrane and a cathode.

A further object of the present invention is to provide an electrolytic process which also for the retrofitting of a mercury electrolytic cell to a horizontal type cation exchange membrane electrolytic cell.

Other objects of the present invention will be made apparent from the following description.

BRIEF DESCRIPTION OF THE DRAWING

FIG. 5 is a partial cutaway front view illustrating an embodiment of a horizontal type electrolytic cell used in the present invention.

FIG. 6 is a schematic illustration showing a catholyte liquor-circulating system.

DETAILED DESCRIPTION OF THE INVENTION

The present invention is concerned with an electrolytic process using a horizontal electrolytic cell partitioned by a cation exchange membrane positioned substantially horizontal dividing the cell into an upper anode compartment and a lower cathode compartment. The cathode compartment having therein a gas-liquid impermeable cathode plate. Electrolysis is effected while supplying into the cathode compartment catholyte liquor for enfolding cathode gas generated in a space formed between the cation exchange membrane and the cathode plate to form a mixed stream of the cathode gas and the catholyte liquor, and discharging the mixed stream from the cathode compartment, said catholyte liquor having the flow rate satisfying the following equation;

$$Y \geqq 9 \log_{10} X + 11 \quad (I)$$

wherein Y is linear velocity (cm/sec) of the catholyte liquor containing no cathode gas or containing cathode gas in an extremely small amount, and X is the length (m) of a passageway of the catholyte liquor in the cathode compartment.

In the present invention, under the cation exchange membrane the anode compartment or the cathode compartment may be provided. However, the less-corrosive electrolyte is preferred because a great amount of electrolyte has to be supplied and circulated. Therefore, the cathode compartment had better be provided under the membrane.

The present invention has been completed based on the discovery, through an extensive series of studies by the present inventors using a horizontal cation exchange membrane electrolytic cell with the cathode compartment under the membrane, that the residence of cathode gas in a space between the cathode and the membrane can be prevented by serving a gas-liquid impermeable cathode plate. As a result, a high quality caustic soda can be obtained with low cell voltage and with high efficiency, and further that problems attendant to the conventional arts can be solved by controlling to a specific value, or above, the initial linear velocity of catholyte liquor supplied to the cathode compartment. This value has a close relation with the residence of gas and cell voltage.

Figure 1:
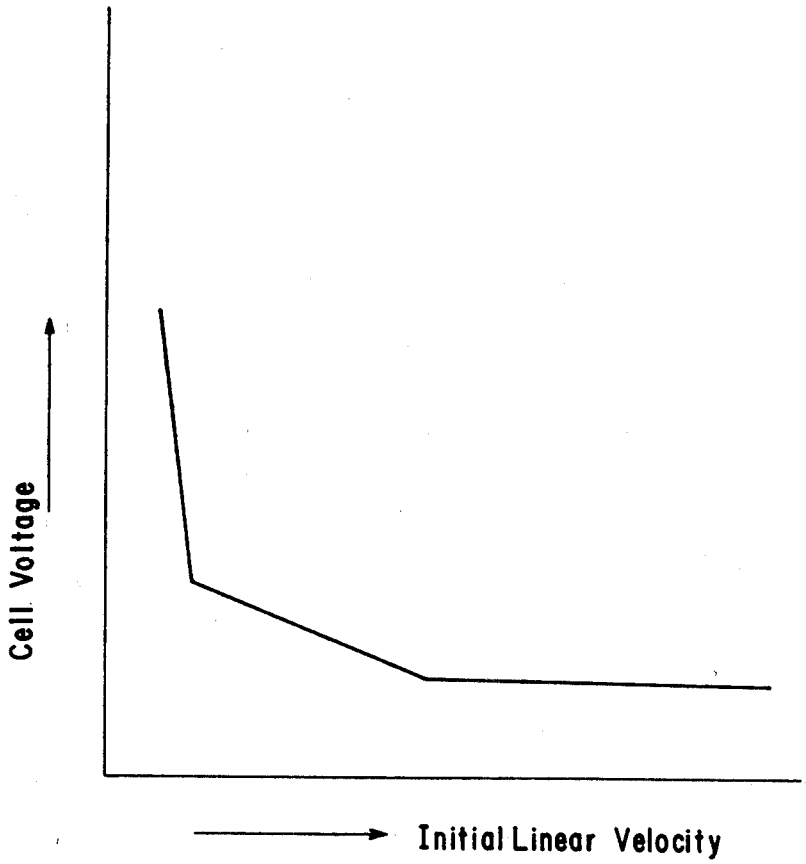
FIG. 1 is a graph showing the relative relationship between the initial linear velocity of catholyte liquor in a cathode compartment and cell voltage.

Investigation was made as to the relationship between the initial linear velocity within the cathode compartment of the catholyte liquor supplied to the cathode compartment and cell voltage. FIG. 1 is a graph showing the relative relationship between the initial linear velocity of the catholyte liquor and cell voltage.

In the present invention, the initial linear velocity means the following. The catholyte liquor supplied into the cathode compartment entrains gas evolved by the electrolysis while flowing in the cathode compartment so that the velocity of the catholyte liquor flow generally increases as approaching to the outlet. Hence, the linear velocity of the catholyte liquor containing no gas in the neighborhood of the catholyte liquor inlet or containing a small amount of gas, if any, is called the initial linear velocity.

As is apparent from FIG. 1, the cell voltage decreases abruptly with an increase in velocity of the catholyte liquor. The cell voltage then decreases gradually, and thereafter arrives at the steady state approximately. The abrupt decrease of cell voltage up to the first turning point is supposed to take place because of a rapid reduction in the residence of gas on the underside of the cation exchange membrane with an increase in the velocity. The slow decrease of cell voltage from the first turning point to the second turning point is probably caused by a decreased deposition of gas onto the surfaces of the cathode and the cation exchange membrane with an increase in the velocity.

Figure 2:
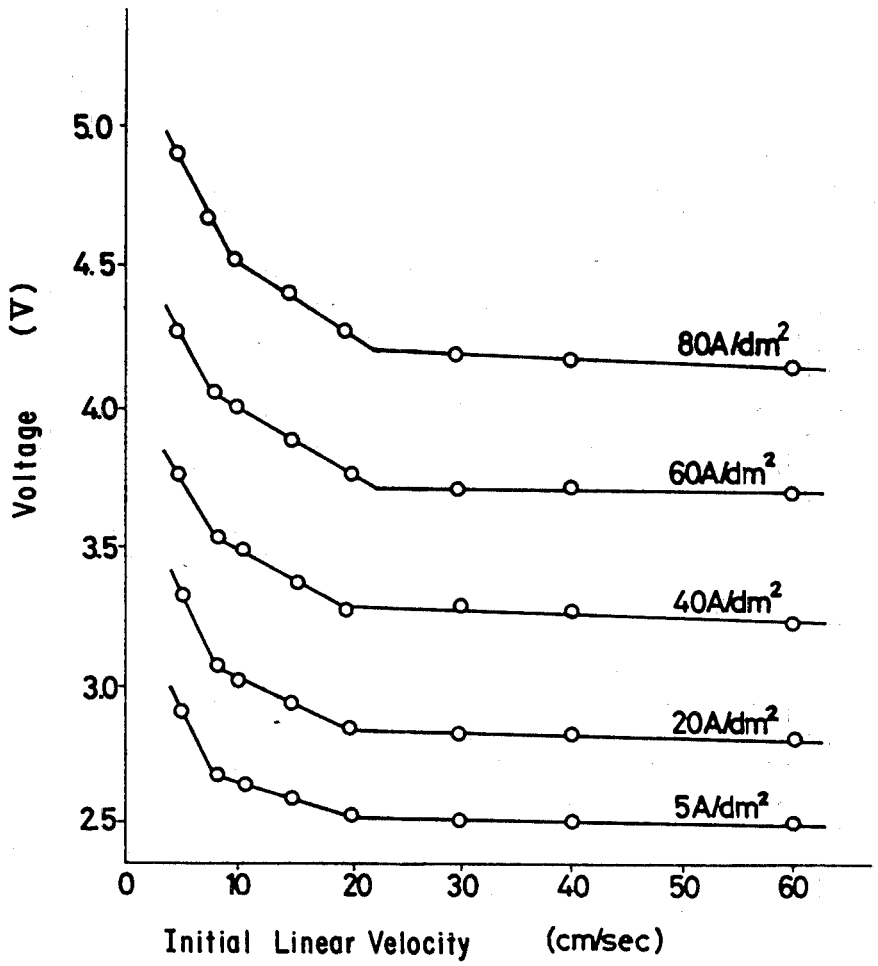
FIG. 2 is a graph showing the relationship between current density, initial linear velocity and cell voltage.

In FIG. 2, there are given the results obtained by measuring cell voltage at the initial linear velocity while the current density is varied between 5 A/dm$^2$ and 80 A/dm$^2$ using an electrolytic cell having the catholyte liquor passageway of 70 cm. It has been found out by the present inventors that although the turning points as seen in FIG. 2 appear at approximately the same initial linear velocity in the range of from about 5 to about 80 A/dm$^2$, having almost no connection with current density, there is a shift to the side of higher initial linear velocity as the distance from a catholyte liquor inlet to an outlet (i.e., passageway of the catholyte liquor) becomes long.

Figure 3:
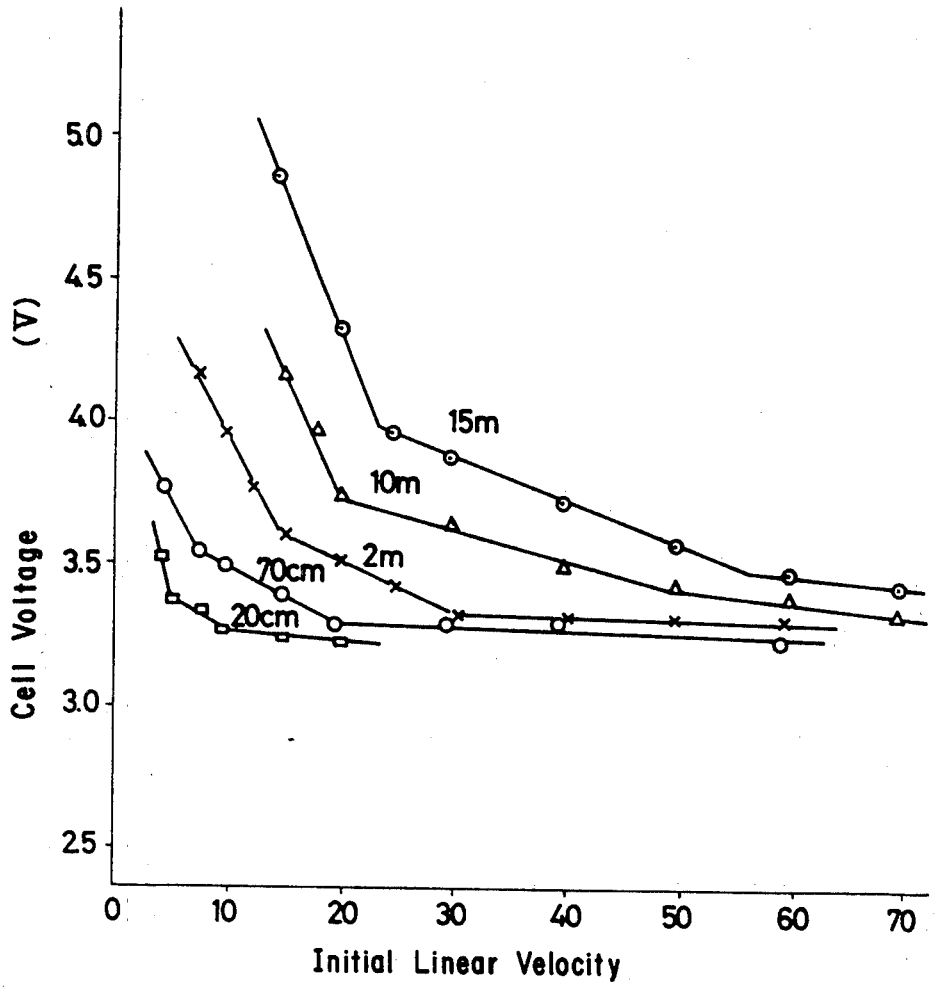
FIG. 3 is a graph showing the relationship between the length of cell, initial linear velocity and cell voltage.

FIG. 3 shows the results obtained by measuring cell voltage at various initial linear velocities of the catholyte liquor maintaining current density constant at 40 A/dm$^2$, by the use of various electrolytic cells having the catholyte liquor passageway ranging from 20 cm to 15 m.

Figure 4:
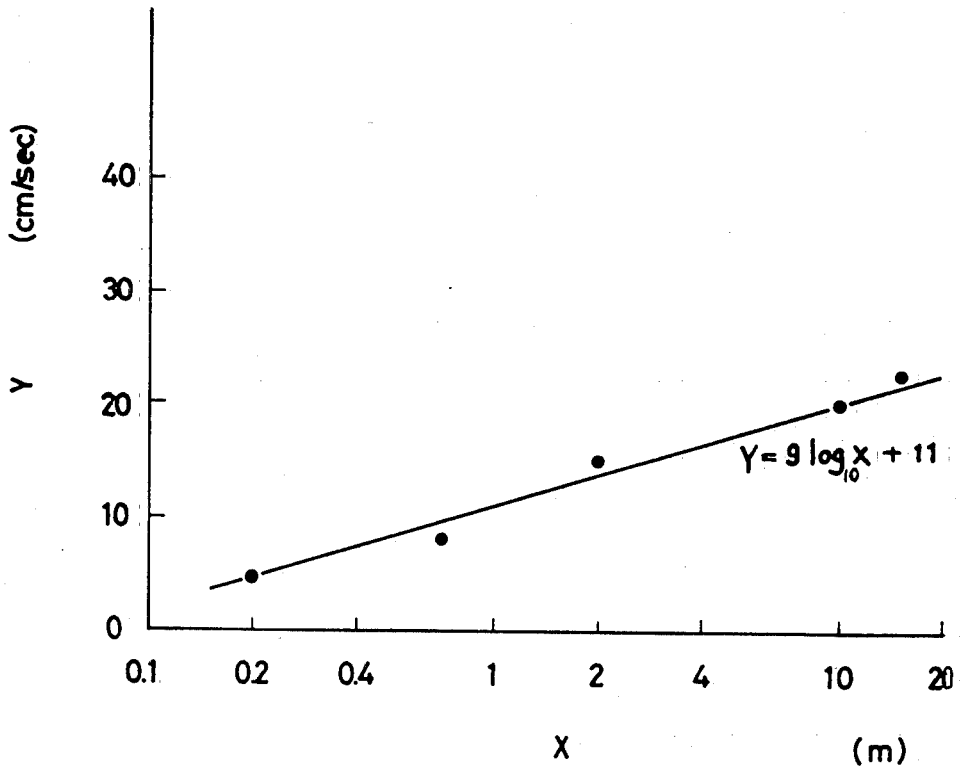
FIG. 4 is a graph showing the relationship between the length of catholyte liquor passageway and initial linear velocity at the first turning point shown by FIG. 2 and FIG. 3.

In FIG. 4, corresponding points between the initial linear velocity and the catholyte liquor at the first turning point in FIG. 2 and FIG. 3 were obtained and plotted, with the length of catholyte liquor passageway as the abscissa and the initial linear velocity as the ordinate. As obvious from FIG. 4, the initial linear velocity for obtaining cell voltage lower than the first turning point should be within a range satisfying the following equation;

$$Y \geqq 9 \log_{10} X + 11 \quad (I)$$

wherein,

Y: initial linear velocity (cm/sec)

X: catholyte liquor passageway length (m)

Therefore, in order to obtain a high quality caustic soda with high efficiency at low cell voltage according to the electrolytic process of the present invention, it is necessary to operate the processes while maintaining the initial linear velocity, at which the catholyte liquor is supplied to the cathode compartment, satisfying the equation (I).

The cation exchange membrane used suitably in the present invention includes, for example, membranes made of perfluorocarbon polymers having cation exchange groups. A membrane made of a perfluorocarbon polymer containing sulfonic acid groups as a cation exchange group is sold by E. I. Du Pont de Nemours & Company under the trade mark "NAFION" having the following chemical structure;

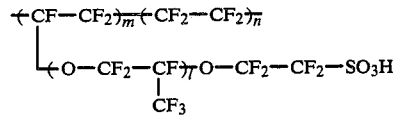

The equivalent weight of such cation exchange membranes is preferred in a range between 1,000 and 2,000, more preferably in a range between 1,100 and 1,500.

The equivalent weight herein means weight (g) of a dry membrane per equivalent of an exchange group. Moreover membranes whose sulfonic acid groups are substituted, partly or wholly, by carboxylic acid groups and other membranes widely used can also be applied to the present invention. These cation exchange membranes exhibit very small water permeability so that they permit the passage of only sodium ion with three to four molecules of water, while hindering the passage of hydraulic flow.

Hereinafter, embodiments of the present invention will be explained in detail by referring to the drawings attached. The following explanation is referred, as a matter of convenience, to sodium chloride which is most popular in the industry and typical of alkali metal halides, and to caustic soda as an electrolytic product. However, the present invention is not limited, the present invention being applicable to the electrolysis of an aqueous solution of other inorganic salts such as potassium chloride, water and the like.

FIG. 5 is a partial cutaway front view showing a horizontal electrolytic cell of the present invention.

In FIG. 5, an electrolytic cell of the present invention is comprised of an anode compartment (1) and a cathode compartment (2) located thereunder, both compartments being of a rectangular shape having the greater length than the width, preferably several times the length. The anode compartment (1) and the cathode compartment (2) are separated from each other by a cation exchange membrane (3) positioned substantially horizontal between side walls of the compartments. The word "substantially horizontal" also includes the cases where the membrane is positioned at a slight slant (up to a slope of about 2/10).

The anode compartment (1) is formed by a top cover (4), and side walls (5) of the anode compartment which are located so as to enclose anode plates (12) and the upper side of a cation exchange membrane (3). The anodes plates (12) are suspended by anode-suspending devices (7) located on the top cover (4) via anode-conducting rods (6) and are connected to one another by an anode busbar (8). The top cover (4) possesses holes (10) through which anode conducting rod covers (9) are inserted and the holes (10) are sealed airtight by sheets (11). The anode plates (12) are secured to the lower ends of the rod covers (9). As such, the anode plates (12) are connected to the anode-suspending devices (7), so that those can be ascended and descended by the adjustment of the anode-suspending devices (7), thereby being positioned so as to come into contact with the cation exchange membrane (3). Of course, the anodes may also be suspended by other means, not being limited to the cases where those are suspended from the anode-suspending devices positioned to the top cover. For instance, the anodes may be suspended by being secured to an anode compartment frame which is fabricated of the top cover and the side walls, united in one body. Moreover the anode compartment is provided with at least one anolyte solution inlet (13), which may be positioned to the top cover (4) or side walls (5) of the anode compartment. Although not shown in the figures, uniformity of anolyte solution in the anode compartment may also be attained by providing an anolyte solution supplying pipe with perforations, extending over the full length of the anode compartment, and supplying it through the perforations. Moreover, the depleted brine, if necessary, may be partly recirculated to make the concentration and pH of anolyte solution uniform in the anode compartment. On the other hand, at least one anolyte solution outlet (14) is provided and may be positioned to the side walls (5). Furthermore, to a suitable place of the top cover (4) or the side walls (5), an anode gas (chlorine gas) outlet (15) is provided. In this case, the anolyte solution outlet (14) and the anode gas outlet (15) need not necessarily be provided separately, and in some cases, the anolyte solution and the anode gas may be discharged through the common outlet, then subjected to gas-liquid separation outside the cell.

As the material for the top cover (4) and side walls (5) forming the anode compartment (1), a top cover and side walls of an anode compartment of a mercury electrolytic cell may also be converted and any chlorine-resistant material may be effectively used. Examples of such materials are chlorine-resistant metals such as titanium and an alloy thereof, fluorocarbon polymers, hard rubbers and the like. Moreover iron lined with the foregoing metals, fluorocarbon polymers, hard rubbers and the like may also be employed.

As the anode plate (12) on which the anode reaction takes place, perforated electrodes such as expanded metal sheets, net-like or louver-like electrodes, spaghetti-like electrodes and the like may be employed in order to rapidly discharge gas upwardly or non-perforated electrodes may also be employed to thereby circulate anolyte solution between the electrode and the membrane. The foregoing anodes may be fabricated from titanium, niobium, tantalum, an alloy thereof, on the surface of which is coated with platinum group metals, electroconductive oxides thereof and the like. Of course, anode plates used in a mercury electrolytic cell may be directly converted without altering dimensions and shapes.

The cathode compartment (2), on the other hand, is formed by the underside of the cation exchange membrane (3), a cathode plate (16) and side walls (17) of the cathode compartment positioned so as to enclose the cathode plate along the periphery of the cathode plate. The side walls (17) of the cathode compartment may be made of frames having some rigidity or may also be made of packings of rubbers, plastics and the like. Furthermore, the portion of the bottom plate opposing the anodes through the cation exchange membrane is shaved off except the periphery and the remaining bank-like periphery of the cathode plate serves as the side walls of the cathode compartment. Moreover the cathode compartment may be formed as below; That is, a thin layer packing is placed on the periphery of the cathode plate, the anode plates are located upper than the lower flange level of side walls forming the anode compartment and the cation exchange membrane is located along the inside surfaces of the side walls of the anode compartment utilizing the flexibility of the membrane to thus form the cathode compartment.

As the material for the side walls (17) of the cathode compartment, any material resistant to caustic alkali such as sodium hydroxide may be used including, for example, iron, stainless steel, nickel and an alloy thereof. Iron base material lined with alkali-resistant materials may also be suitably used. Materials such as rubbers and plastics may also be used. As those materials, there are exemplified rubbers such as natural rubber, butyl rubber and ethylene-propylene rubber (EPR), fluorocarbon polymers such as polytetrafluoroethylene, copolymers of tetrafluoroethylene-hexafluoropropylene and copolymers of ethylene-tetrafluoroethylene, polyvinyl chloride and reinforced plastics.

As the cathode plate (16) used in the present invention, a bottom plate used in a mercury electrolytic cell may be economically used. The surface of the bottom plate becomes coarse owing to corrosion, errosion caused by mercury, electrical short-circuit and the like, and therefore when the bottom plate is directly served, the cation exchange membrane occasionally rubs against the coarse surface and is thereby damaged. Hence, it is desired to smooth the surface before serving. The smoothing may be attained by plating with nickel, cobalt, chrome, molybdenum, tungsten, platinum group metals, silver and the like, bonding of a thin metal plate made of nickel, austenitic stainless steel and the like, mechanical polishing or other suitable manners.

The gas-liquid impermeable cathode plate may be in any form that does not prevent the catholyte liquor from flowing. The cathode plate may have a substantially flat surface or may have such a protuberant structure surface as provided parallel in the flowing direction of the catholyte liquor. The cathode plate may also have small protrusions on its surface at a suitable interval.

The protuberant structure may be given by shaving off a flat plate to thus form channels in parallel to one another, welding a plurality of thin rods such as round rods and square rods to a flat plate or by uniting protuberances and a flat plate. Moreover the cathode plate may be made of a corrugated plate. The corrugation may be in any form such as rectangular, trapezoidal, sinusoidal or cycloidal shape. The protuberant structure need not necessarily be continuous to a longitudinal way and may be intermittent for the purpose. The concave channels or convex protuberances may not be limited to be provided along the flowing direction of the catholyte liquor, but may be provided in the direction traverse to the flowing direction of the catholyte liquor. When the gas-liquid impermeable cathode plate providing channels or protuberances extending along the flowing direction of the catholyte liquor, it is a preferred embodiment to position the cation exchange membrane to be in contact with or in close proximity to the convexities such as protuberances or protrusions. On the other hand, in case of the cathode plate providing channels or protuberances in the direction traverse to the flowing direction of the catholyte liquor, it is preferred to keep the membrane about 1 to 5 mm apart from the convexities. In this case, dispersion in the flow rate of the catholyte liquor is made uniform by channels or protuberances to minimize dispersion in the direction traverse to the flowing direction of the catholyte liquor, so that operation is effected under good conditions.

The gas-liquid impermeable cathode plate may be fabricated from iron, stainless steel, nickel, nickel alloys and the like. One preferred embodiment is to employ a cathode plate whose surface was subjected to plasma or flame spray with nickel, cobalt, chrome, molybdenum, tungsten, platinum group metals, silver, alloys of the foregoing or mixtures of foregoings or plating or codeposit plating with foregoings with a view to reducing hydrogen overvoltage.

A catholyte liquor inlet (19) and a mixed stream outlet (20) are not specifically limited but sufficient provided that they allow a flow of the catholyte liquor to occur in the cathode compartment (2). Accordingly the flow of the catholyte liquor may be formed either in a longitudinal direction or to a traverse direction of the cell, but the latter is preferred since pressure difference between the inlet and the outlet and the value of $G/(G+L)$ (gas content contained in unit volume of the catholyte liquor) are reduced. For this purpose, the employment of a slit-like inlet is preferred. When a bottom plate of a mercury electrolytic cell is converted the cathode plate, existing bolt holes made thereon for assembly of the cell may be serviceable, directly or with necessary processing, as the inlet or outlet.

Moreover, the catholyte liquor may be supplied or discharged through a flange on a side wall of the anode compartment or a periphery of the catode plate opposite the flange in the direction substantially vertical to the direction of the horizontal surface of the cathode plate, whereby an anode-cathode distance can be minimized.

In FIG. 6, there is given a schematic illustration of a catholyte liquor-circulating system using the horizontal electrolytic cell shown by FIG. 5.

Referring now to FIG. 5 and FIG. 6, an approximately saturated brine is supplied through the anolyte solution inlet (13) into the anode compartment (1) and then electrolysed therein. Chlorine gas generated is removed through the anode gas outlet and depleted brine is discharged through the anolyte solution outlet.

The catholyte liquor is supplied through the catholyte liquor inlet (19) into the cathode compartment (2) and mixed with hydrogen gas evolved in the cathode compartment to provide a mixed stream, discharged through the outlet (20) of the mixed stream, then the mixed stream being transported to a gas-liquid separating device (21) in which hydrogen gas is separated from the caustic liquor. The catholyte liquor containing substantially no hydrogen gas is recirulated by use of a pump (22) through the catholyte liquor inlet (19) to the cathode compartment.

The gas-liquid separating device (21) and the pump (22) may be used for a plurality of cells, or otherwise, one may be provided for each cell.

The electric current is supplied to an anode busbar (8), passing through the cathode plate (16) of the cathode compartment (2) and then is taken out from a cathode busbar (18).

In the anode compartment (1), the following reaction takes place;

$$Cl^- - e^- \rightarrow \tfrac{1}{2}Cl_2$$

Sodium ions in the anode compartment (1) move through the cation exchange membrane (3) to the cathode compartment (2). In the cathode compartment (2), on the other hand, the following reaction occurs;

$$H_2O + e^- \rightarrow \tfrac{1}{2}H_2 + OH^-$$

In the cathode compartment sodium hydroxide is produced by reaction of hydroxyl ions with sodium ions transported through the cation exchange membrane (3) from the anode compartment (1), concurrently with evolution of hydrogen gas.

It is advantageous to recirculate back to the catholyte liquor inlet (19) at least a part of the catholyte liquor which is supplied into the cathode compartment and removed together with hydrogen gas and caustic soda produced and then separated from hydrogen gas by the gas-liquid separating device (21). This is because the concentration of caustic soda can be increased optionally and adjusted by being diluted with water.

In practicing the present invention, it is very effective for preventing vibration of the membrane and consequently extending the lifetime to effect the electrolysis while pressing a portion of the membrane substantially taking part in the electrolysis against anodes. The pressing of the membrane against the anodes may be attained by known processes. For example, by choking a valve provided to the catholyte liquor outlet, pressure can be imposed on the whole cathode side of the membrane. It may also be achieved by the pressure of hydrogen gas generated on the cathode. It may further be attained by attracting the membrane to the anode side with increased sucking force of anode gas.

The positive pressure imposed on the cathode side of the cation exchange membrane in the vicinity of the catholyte liquor outlet, i.e., difference in pressure on the membrane between the anode side and the catode side, should be greater than a change in pressure imposed on the membrane. Under the general electrolytic conditions, i.e., at current density ranging from 5 to 80 $A/dm^2$ and at the length in a catholyte liquor-circulating direction of the cathode compartment ranging from 1 to 15 m, it has been discovered by the inventors that the change in pressure is between about 100 mm HO and about 1,000 mm HO. Accordingly the difference in pressure required to be imposed on the membrane is at least about 100 mm HO and not exceeding about 10 m HO. Is the difference in pressure exceeds about 10 m HO the membrane is pressed against the anodes with force stronger than required and this leads to damage of the membrane.

Hereinafter the present invention will be explained in more detail by way of Experimental Examples that follow. The invention is in no way limited by the Examples.

EXPERIMENTAL EXAMPLE 1

"NAFION 901" (sold by E. I. Du Pont de Nemours & Co.) served as a cation exchange membrane, was positioned substantially horizontal over a substantially flat cathode plate comprising a bottom plate of a mercury electrolytic cell whose surface was subjected to plasma flame spray with nickel, having the length of 11 m and the width 1.8 m. Said cathode plate was provided with partitions of a soft rubber, 2.5 mm high and 7 mm wide, arranged at an interval of 35 cm in the traverse direction to the longitudinal direction of the cathode plate and the top of the partitions was brought into contact with the membrane. Supply or removal of the catholyte liquor was made through a branch pipe for each partition so that the length of the passageway of the catholytic liquor was substantially 1.8 m.

As an anode, a DSE for use in a mercury electrolytic cell, i.e. a titanium expanded metal sheet whose surface was coated with $RuO_2$ and $TiO_2$ was used and situated so as to bring a working surface of the anode into contact with the membrane. An electrolytic cell so constructed and an operation system were such as shown by FIG. 5 and FIG. 6, though partitions were further provided on the cathode plate shown by FIG. 5.

In an anode compartment, a part of depleted brine was recirculated to control concentration of the depleted brine to 3.5N, while in a cathode compartment a part of catholyte liquor was recirculated to control concentration of caustic soda to 32%. The temperature was maintained at 85±1° C. at a current density of 30 $A/dm^2$.

Cell voltage was measured while supplying the catholyte liquor at an initial linear velocity within the cathode compartment of 5 cm/sec, 15 cm/sec, 30 cm/sec and 50 cm/sec, respectively. Obtained results were given in Table 1.

TABLE 1

| Initial linear velocity (cm/sec) | 5 | 15 | 30 | 50 |
|---|---|---|---|---|
| Cell voltage (V) | 3.82 | 3.24 | 3.12 | 3.11 |

In the foregoing equation (I), when the passageway length $X=1.8$, $Y \geqq 13.3$ cm/sec and therefore Table 1 shows that when $Y=5$ cm/sec, cell voltage is exceedingly high.

EXPERIMENTAL EXAMPLE 2

As a cation exchange membrane, "NAFION 901" was used and positioned substantially horizontal to a horizontal electrolytic cell provided with a cathode plate having a working surface, 11 m long and 1.8 m wide. The cathode plate possessed channels, 6 mm deep and 8 mm wide at an interval of 16 mm, running parallel to the longitudinal direction and situated so as to bring the convexities formed between adjacent channels into contact with the membrane.

As an anode, a titanium expanded metal sheet whose surface was coated with a solid solution of $RuO_2$ and $TiO_2$ was used and situated to come in contact with the upper surface of the membrane.

Into an anode compartment, substantially saturated NaCl brine was supplied and the concentration of depleted brine was controlled to 3.5N. Catholyte liquor was controlled to keep a concentration of 32% by the addition of water. The temperature was maintained at 85±1° C. at current density of 30 $A/dm^2$.

Cell voltage was measured while the circulating amount of the catholyte liquor was varied for the initial linear velocity to become 15 cm/sec, 25 cm/sec, 50 cm/sec and 150 cm/sec, respectively. Table 2 shows the results.

TABLE 2

| Initial linear velocity (cm/sec) | 15 | 25 | 50 | 150 |
|---|---|---|---|---|
| Cell voltage (V) | 4.08 | 3.41 | 3.20 | 3.05 |

In the above equation (I), with the passageway length $X=11$, the initial linear velocity $Y \geqq 20.4$ cm/sec. It is therefore understood that when $Y=15$ cm/sec, cell voltage amounts to as high as 4.08 V.

What we claim is:

1. In an electrolytic process for the electrolysis of an aqueous alkali metal halide solution using a horizontal electrolytic cell partitioned by a cation exchange membrane which is positioned substantially horizontal into an upper anode compartment and a lower cathode compartment, said cathode compartment having therein a gas-liquid impermeable cathode plate, the improvement which comprises: carrying out electrolysis while supplying into the cathode compartment a catholyte liquor for enfolding cathode gas generated in a space formed between the cation exchange membrane and the cathode plate to thus form a mixed stream of the cathode gas and the catholyte liquor, and discharging the mixed stream from the cathode compartment, said catholyte liquor having a flow rate satisfying the following equation:

$$Y \geqq 9 \log_{10} X + 11 \quad (I)$$

wherein Y is the initial linear velocity (cm/sec) of the catholyte liquor containing no cathode gas or containing cathode gas in an extremely small amount, and X is the length (m) of a passageway of the catholyte liquor in the cathode compartment.

2. The electrolytic process of claim 1, wherein the surface of the cathode plate is substantially flat.

3. The electrolytic process of claim 1, wherein the surface of the cathode plate has a protuberant structure comprising protuberances and channels running in the direction of the flow of the catholyte liquor.

4. The electrolytic process of claim 1, wherein the process is performed at a current density in the range of 5 to 80 $A/dm^2$.

5. The electrolytic process of claim 1, wherein a horizontal electrolytic cell is retrofitted from a mercury electrolytic cell.

* * * * *